US008698019B2

(12) United States Patent
Kim

(10) Patent No.: US 8,698,019 B2
(45) Date of Patent: Apr. 15, 2014

(54) BUTTON FOR ELECTRIC PRODUCT

(75) Inventor: Youn Soo Kim, Seoul (KR)

(73) Assignee: Intellectual Discovery, Inc., Seoul (KR)

( * ) Notice: Subject to any disclaimer, the term of this patent is extended or adjusted under 35 U.S.C. 154(b) by 272 days.

(21) Appl. No.: 12/665,910

(22) PCT Filed: Jun. 18, 2008

(86) PCT No.: PCT/KR2008/003432
§ 371 (c)(1),
(2), (4) Date: Dec. 21, 2009

(87) PCT Pub. No.: WO2009/002039
PCT Pub. Date: Dec. 31, 2008

(65) Prior Publication Data

US 2012/0006660 A1 Jan. 12, 2012

(30) Foreign Application Priority Data

Jun. 22, 2007 (KR) ..... 10-2007-0061359
Apr. 22, 2008 (KR) ..... 10-2008-0037207

(51) Int. Cl.
*H01H 13/50* (2006.01)

(52) U.S. Cl.
USPC ..... 200/17 R

(58) Field of Classification Search
USPC ..... 200/6 A, 17 R, 16 C
See application file for complete search history.

(56) References Cited

U.S. PATENT DOCUMENTS 5,738,352 A * 4/1998 Ohkubo et al. ..... 273/148 B
5,823,057 A * 10/1998 Hsien ..... 74/471 XY
6,496,181 B1 * 12/2002 Bomer et al. ..... 345/167
6,689,967 B2 * 2/2004 Myojin ..... 200/18
6,700,565 B2 * 3/2004 Niiyama ..... 345/172
6,831,238 B1 12/2004 Lau
6,906,269 B2 * 6/2005 Nishimura et al. ..... 200/4
6,919,522 B2 * 7/2005 Uehira ..... 200/341
7,294,795 B1 * 11/2007 Kondo et al. ..... 200/5 R
2006/0103628 A1 5/2006 Akieda et al.
2010/0193341 A1 * 8/2010 Uotani ..... 200/5 A

FOREIGN PATENT DOCUMENTS

JP 59-175518 A 10/1984
JP 61-00218 A 1/1986
JP 07-114859 5/1995
JP 2000-235822 A 8/2000
JP 2001-266715 A 9/2001
JP 2001345031 A * 12/2001 ..... H01H 25/04
JP 2002-157076 A 5/2002
JP 2003-015809 A 1/2003

(Continued)

OTHER PUBLICATIONS

International Search Report from PCT/KR2008/003432, Mailed Dec. 18, 2008.

*Primary Examiner* — Briggitte R Hammond
(74) *Attorney, Agent, or Firm* — NSIP Law

(57) ABSTRACT

Disclosed herein is a button structure for electronic products. The button structure includes a push button, a restoring means, and an opposite sidewall. The push button is configured such that a plurality of contacts is provided along the circumference thereof. The restoring means includes a central shaft, which is provided in the central portion of the push button. The opposite sidewall is spaced apart from the contacts, and is configured to surround the push button, and is configured such that sensors for generating their corresponding signals are provided on the opposite sidewall at respective locations opposite those of the contacts.

8 Claims, 15 Drawing Sheets

(56) References Cited

FOREIGN PATENT DOCUMENTS

| | | | |
|---|---|---|---|
| JP | 2003-031076 | A | 1/2003 |
| JP | 2003-151404 | A | 5/2003 |
| JP | 2003-242862 | A | 8/2003 |
| JP | 2005-228593 | A | 8/2005 |
| JP | 2006-209802 | A | 8/2006 |
| KR | 2007041094 | | 4/2007 |

* cited by examiner

-- PRIOR ART --

(a)

(b)

(a)

(b)

(a)

(b)

(a)

(b)

(a)

(b)

(a)

(b)

BUTTON FOR ELECTRIC PRODUCT

CROSS-REFERENCES TO RELATED APPLICATIONS

This application is a U.S. national phase application, pursuant to 35 U.S.C. §371 of PCT/KR2008/003432, filed Jun. 18, 2008, designating the United States, which claims priority to Korean Application No. 10-2007-0061359, filed Jun. 22, 2007, which claims priority to Korean Application No. 10-2008-0037207 filed Apr. 22, 2008. The entire contents of the aforementioned patent applications are incorporated herein by this reference.

TECHNICAL FIELD

The present invention relates to a button structure for electronic products, in which a pressing button, a touch sensor, or a wheel key part is included in a push button.

BACKGROUND ART

FIG. 1 is a schematic view showing the button structure of a conventional remote controller, which is one example of an electronic product.

The button structure of a conventional electronic product, for example, a remote controller, shown in FIG. 1, is described below.

The remote controller 10 is configured such that a plurality of buttons 20 having various functions is arranged on a casing 12.

Furthermore, the buttons 20 are operated when they are pressed downwards, and only a single signal is generated from a single button 20.

However, the above-described remote controller 10 having a pressing-type button structure is problematic in that a plurality of buttons 20 must be pressed in turns when it is necessary to transmit a plurality of signals.

Furthermore, the size of each button 20 must conform to the size of a finger. However, in the case where the size of a button 20 is excessively smaller than the area of a finger or in the case where the gap with another neighboring button 20 is too narrow, there is a problem in that an inconvenience, such as needing to pay attention so as not to erroneously push the buttons, may occur.

Furthermore, the plurality of buttons 20, having the same shapes, are arranged on the remote controller parallel to each other, so that there is a problem in that a desired button 20 must be manipulated after the location thereof has been viewed because the desired button cannot be recognized without glancing.

In particular, electronic products, such as mobile phones, MP3 players and navigation systems, which are currently being used, are greatly trending towards compactness. Accordingly, if a large number of buttons are attached thereto thus unnecessarily taking up too much space, there is a problem in that inconvenience in the operation occurs and, in addition, the desire to purchase becomes attenuated, and thus a reduction in sales easily results.

DISCLOSURE OF INVENTION

Technical Problem

Accordingly, the present invention has been made keeping in mind the above problems occurring in the prior art, and an object of the present invention is to provide an integrated button structure, which is provided with a button formed by integrating various types of buttons, such as a pressing-type button and a touch-type button, as well as a push button, which is configured to transmit a plurality of signals using a single button, to which a plurality of contacts is attached, thus generating various signals.

Technical Solution

In order to accomplish the above object, the present invention provides a button structure for electronic products, including: a push button (200) configured such that a plurality of contacts (400) is provided along the circumference thereof; a restoring means (600) comprising a central shaft (608), which is provided in the central portion of the push button (200); and an opposite sidewall (130) spaced apart from the contacts (400), configured to surround the push button (200), and configured such that sensors for generating their corresponding signals are provided on the opposite sidewall (130) at respective locations opposite those of the contacts (400); wherein, when the push button (200) is moved without rotating around the axis of the central shaft (608), a contact (400) is brought into contact with a corresponding sensor, which is provided on the opposite sidewall (130) and, then, the push button (200) is restored to its original position by the elasticity of the restoring means (600).

Furthermore, the plurality of contacts (400) may generate their corresponding signals, the sensors or the contacts (400) may form protrusions, and the push button (200) may include a finger contact part (500).

Furthermore, the push button (200) may has a circular or polygonal transverse cross section, the button structure may further include a gap cover (710) provided between the push button (200) and the opposite sidewall (130), and the restoring means (600) may include springs (610), which are connected to the central shaft (608).

The restoring means (600), including the central shaft (608), may be an elastic member (405), and the button structure may further including a stick (700) provided on the upper side of the push button (200).

In addition, the present invention provides a button structure for electronic products, including: a central shaft (608); a push button moved without rotating around the axis of the central shaft (608); and an opposite sidewall (130) configured to surround the push button and to transmit a signal to a side surface of the push button or receive a signal from the side surface of the push button.

Furthermore, the button structure may further include a plurality of contacts or sensors, which is provided on the side surface of the push button or on the opposite sidewall, the contacts or the sensors are pressure sensors, optical sensors or ultrasonic sensors, and the push button and the opposite sidewall, on which the pressure sensors are provided, may be arranged so as to be able to be brought into contact with each other.

Furthermore, a signal may be generated when the push button approaches the opposite sidewall in a state in which the push button and the opposite sidewall, on which the optical sensors or the ultrasonic sensors are provided, are separated from each other, a signal varies according to in a pressure applied when the push button presses the opposite sidewall and is transmitted, and the signal varies according to a velocity, with which the push button approaches the opposite sidewall, and an approaching distance and is transmitted.

Meanwhile, the push button may include at least one of a pressing button, a touch sensor and a wheel key part, the button structure may further include a unified display part (564), which is spaced apart from the push button, and the button structure may further include display windows (554), which are provided around the contacts of the push button.

Furthermore, the button structure may further include a restoring means, which is provided in the push button, and the button structure may further include a stick (700), which is provided on the upper side of the push button.

In addition, the present invention provides a button structure for electronic products, including: a push button (541) having a cap shape; an inner bar (542) provided in the push button (541); and at least one of a pressing button, a touch sensor and a wheel key part provided in the push button.

Furthermore, a plurality of contacts may be provided on either the inner side surface of the push button (541) or the side surface of the inner bar (542), and sensors may be provided at respective locations opposite those of the contacts.

Advantageous Effects

According to the present invention, a button structure for electronic products which is configured to transmit a plurality of signals using a single button, to which a plurality of contacts is attached, is provided.

The button structure for electronic products according to the present invention can perform a large number of button functions using a simple construction.

That is, the present invention can provide an integrated button structure, which is provided with a button, which is formed by integrating various types of buttons, such as a pressing-type button and a touch-type button, as well as a push-type button, thus generating various signals.

The touch- and push-type button is configured to transmit signals via the contacts and the touch sensor, so that, when the corresponding button is merely touched, the effect of pressing a button can be achieved and, in addition, a large number of signals can be generated through a push operation, which is performed before or after a touch operation.

The display push button can generate various signals using one or two push buttons without requiring that a plurality of push buttons be used.

DESCRIPTION OF REFERENCE NUMERALS OF PRINCIPAL ELEMENTS

Figure 1:
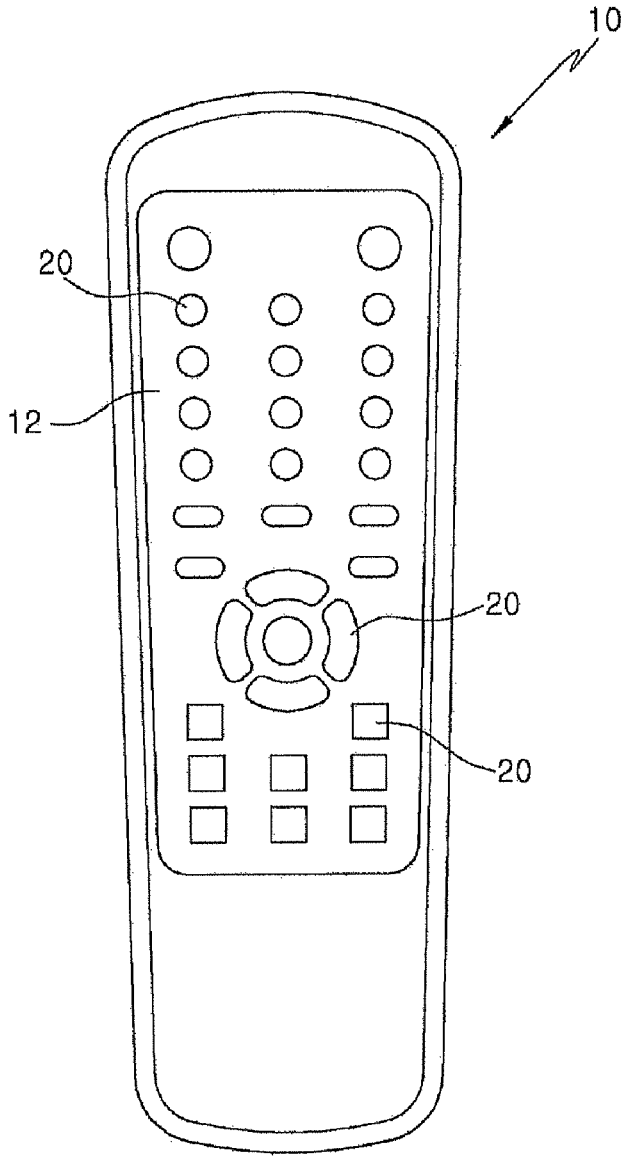
FIG. 1 is a schematic view showing a button structure of a conventional remote controller, which is one example of electronic products.

100: remote controller
200, 541, 552, 566: push buttons
201: press and push button
210: wheel key push button
300: protrusion sensors 400: contacts
500: finger contact part 540: bar-type push button
550: display push button 570: pressure push button
600: restoring means 608: central shaft
610: springs 620: pressing members
625: spring seating parts

MODE FOR THE INVENTION

Preferred embodiments of the present invention are described in detail with reference to the accompanying drawings below. First, it should be noted that, when reference numerals are used to indicate the components of each drawing, the same reference numerals are used throughout the different drawings to designate the same or similar components. In the description of the present invention, when it is determined that detailed descriptions of well-known constructions or functions may be unnecessary and may make the gist of the present invention unclear, the detailed descriptions will be omitted.

A first embodiment of the present invention is a simple push button.

Figure 2:
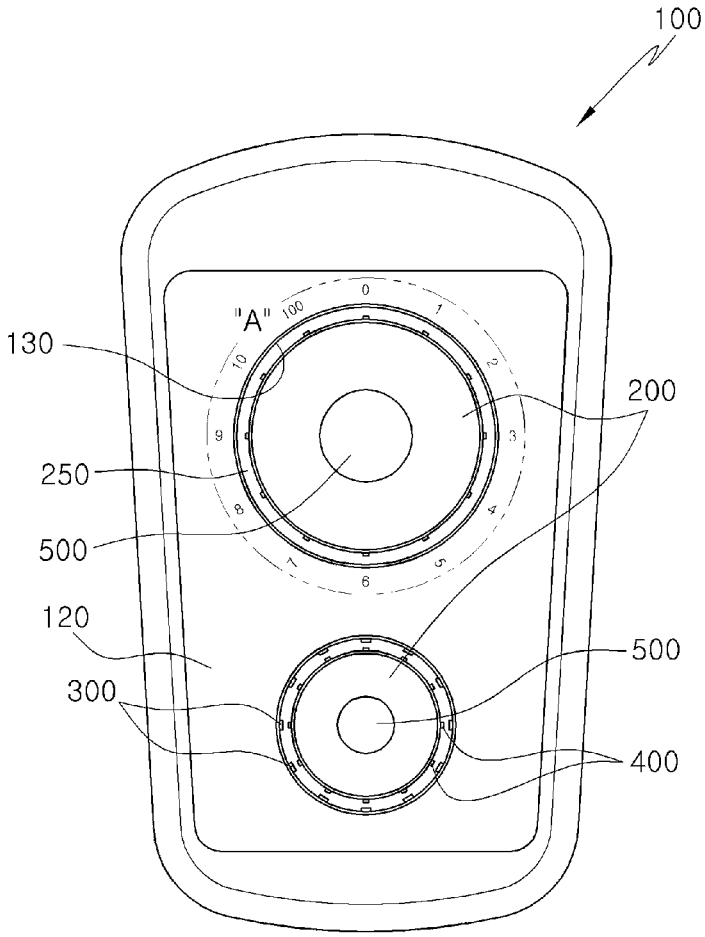
FIG. 2 is a schematic view showing a button structure for electronic products, according to a first embodiment of the present invention.
Figure 3:
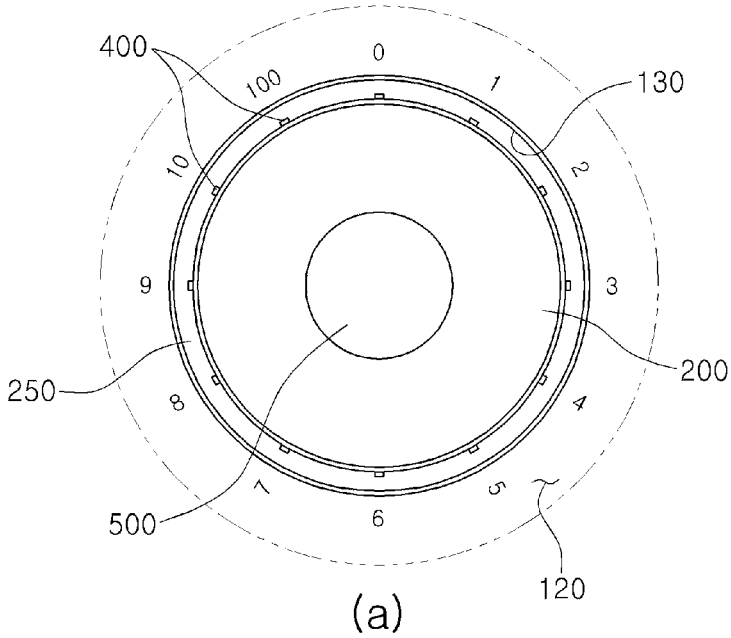
FIG. 3 is an enlarged view showing portion A of FIG. 2.
Figure 3:
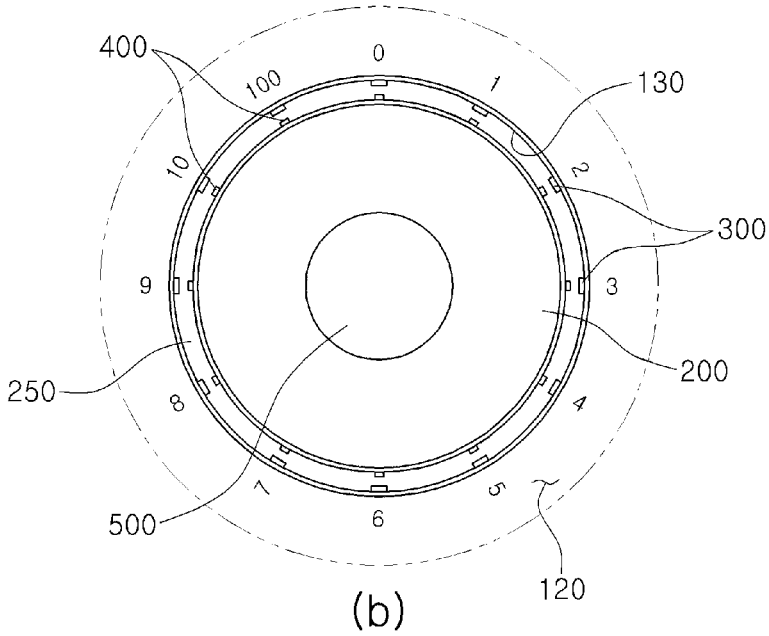
Figure 4:
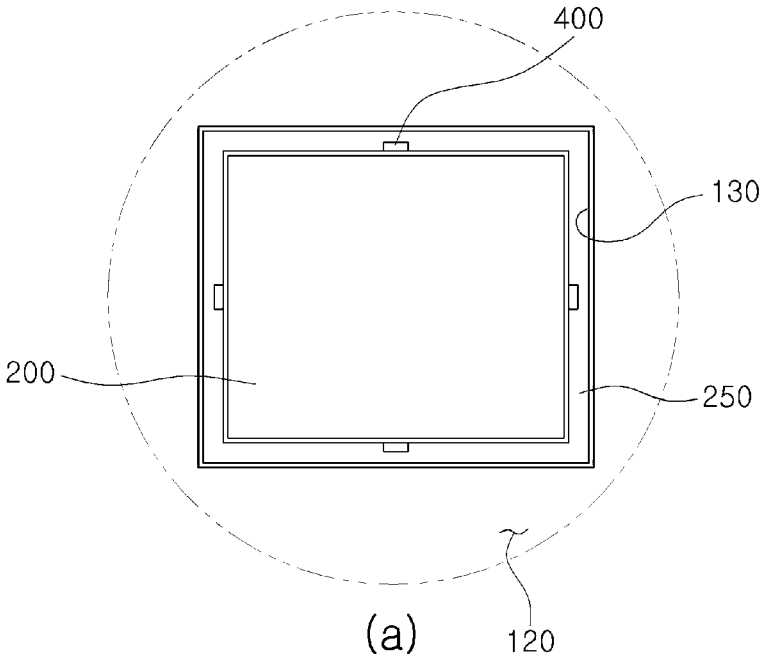
FIG. 4 is a schematic view showing a modification of FIG. 3.
Figure 4:
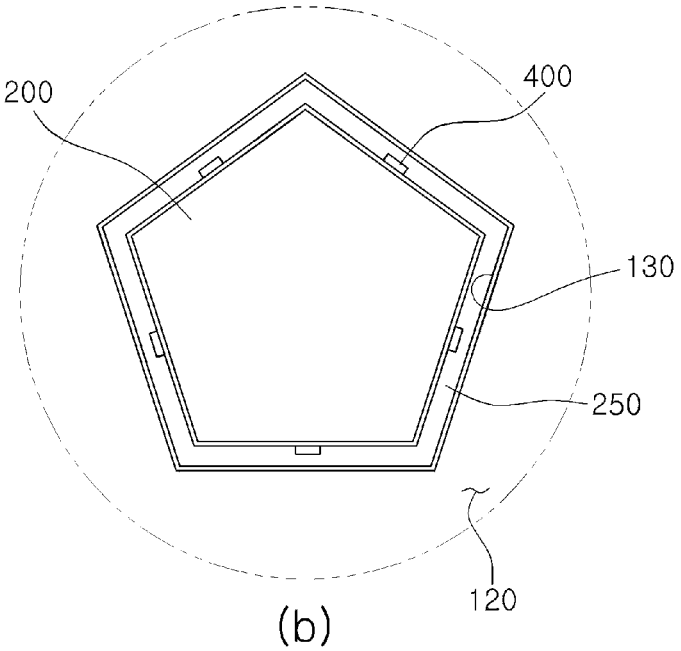

FIG. 2 is a schematic view showing a button structure for electronic products, according to a first embodiment of the present invention, FIG. 3 is an enlarged view showing portion A of FIG. 2, and FIG. 4 is a schematic view showing a modification of FIG. 3.

As shown in FIGS. 2 and 3, the button structure according to the first embodiment of the present may be used in an implementation of a remote controller 100, including one or more push buttons 200, each of which is configured such that a plurality of contacts 400 is formed to protrude from the outer circumferential surface thereof, one or more housings 250, each of which is provided with an opposite sidewall 130, which is spaced apart from the contacts 400 and configured to surround the corresponding push buttons 200, and a casing 120, which is provided with the housings 250.

Furthermore, Arabic numerals ranging from 0 to 10 and also an Arabic numeral of 100 are drawn along the outer circumference of the housing 250. The contacts 400 generate their corresponding signals. In this case, the signals correspond to the above Arabic numerals.

As needed, the Arabic numerals may be changed into letters of the Latin alphabet or the Korean alphabet, and sensors for generating their corresponding signals may be provided at respective predetermined locations on the opposite sidewall 130, which comes into contact with the contacts 400, rather than causing the contacts 400 to generate their corresponding signals.

Alternately, as shown in FIG. 3(*b*), the sensors may be provided in the form of protrusion sensors 300, which protrude toward the contacts 400 from locations opposite those of the contacts 400. In this case, the protrusion sensors 300 function to enable the contacts 400 to be more easily brought into contact with the neighboring opposite sidewall 130 when the contacts 400 are moved in the direction of the opposite sidewall 130.

Meanwhile, finger contact parts 500, which are formed to be concavely curved, are provided in the respective upper portions of the push buttons 200. In this case, the finger contact parts 500 enable the push buttons 200 to be more reliably and accurately manipulated when the push buttons 200 are manipulated by placing fingers on the finger contact parts 500.

Furthermore, the push buttons 200 are generally mounted in a circular shape, as shown in FIG. 3, but, as needed, the push buttons 200 may be mounted in the form of a variety of shapes, as shown in FIG. 4. The push buttons 200 and the housings 250 may be formed to have a polygonal transverse cross section, such as a tetragonal, shown in FIG. 4(*a*), or a pentagonal, shown in FIG. 4(*b*).

Meanwhile, the internal structure of a push button 200 is described below.

Figure 5:
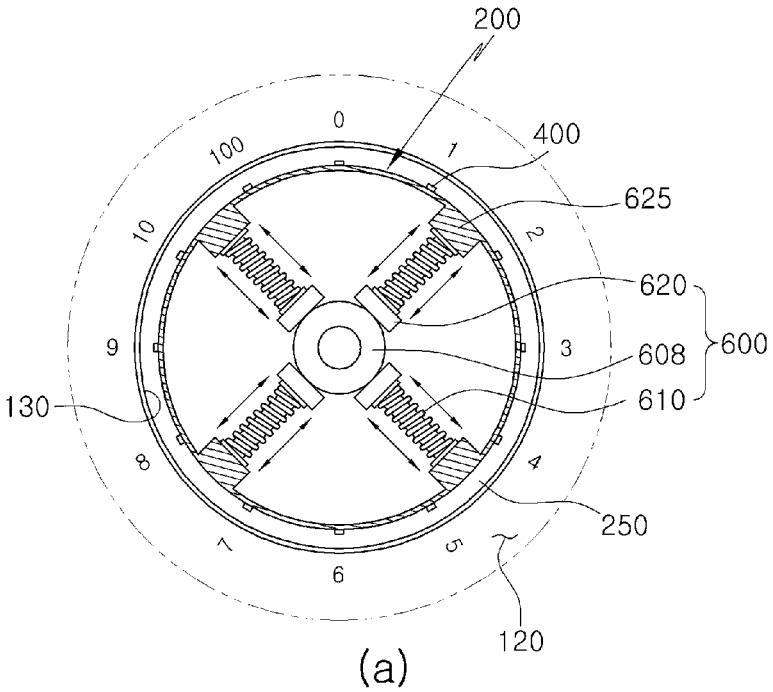
FIG. 5 is a sectional view showing the internal structure of the button shown in FIG. 3.
Figure 5:
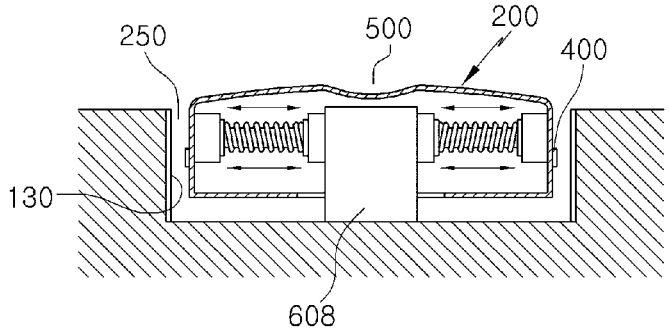
Figure 6:
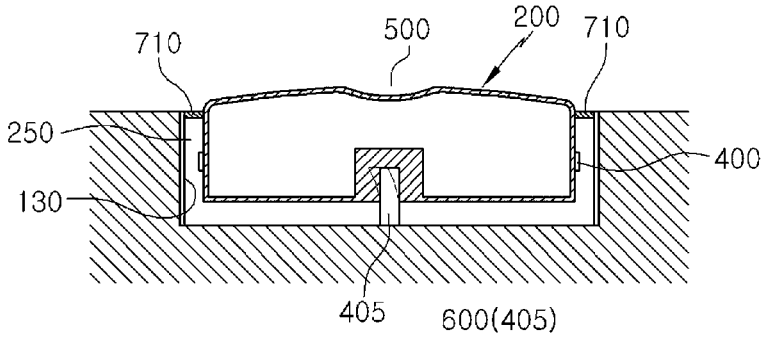
FIG. 6 is a schematic view showing a modification of FIG. 5.

FIG. 5 is a sectional view showing the internal structure of the button shown in FIG. 3, and FIG. 6 is a schematic view showing a modification of FIG. 5.

A restoring means 600 is provided in the push button 200, and is configured such that the button is restored to its original position when a user releases after moving the push button 200.

Furthermore, although, in the present invention, various types of restoring means 600 may be provided, a first type of restoring means 600, shown in FIG. 5, and a second type of restoring means 600, shown in FIG. 6, will be described below.

The first type of restoring means 600, shown in FIG. 5, includes a central shaft 608, which is provided in the central portion of the push button 200, and springs 610, which are connected to the central shaft 608 at 90 degree intervals in the circumferential direction of the central shaft 608.

Furthermore, pressing members 620 are provided between the central shaft 608 and the springs 610, and spring seating parts 625 are formed on the internal sidewall of the push button 200.

Furthermore, the springs 610 all have the same elasticity, so that the push button 200 is always located in the central portion of the housing 250 except for the case where the user operates the push button 200, by which the contacts 400 are prevented from being in contact with the opposite sidewall 130.

The second type of restoring means 600, shown in FIG. 6, includes an elastic member 405, which is connected between the housing 250 and the push button 200. The elastic member 405 is formed of a leaf spring, or is made of synthetic resin or synthetic rubber, which has elasticity.

Furthermore, a gap cover 710 is provided between the push button 200 and the opposite sidewall 130, so that the interruption of contact between the contacts 400 and the opposite sidewall 130 due to dust or foreign materials, which enters into the space between the push button 200 and the opposite sidewall 130, can be prevented. In this case, the gap cover 710 is formed in the shape of a thin elastic membrane so as not to interfere with the movement of the push button 200.

The operation of the button structure for electronic products according the first embodiment of the present invention, which is constructed as described above, is described below.

When a user desires to press one numeral in order to manipulate the remote controller 100, it is necessary to move the push button 200 toward the desired numeral, which is one of the Arabic numerals that are provided along the circumference of the housing 250. When the push button 200 is moved without rotating around the axis of the central shaft 608, a contact 400 is brought into contact with a corresponding protrusion sensor 300, which is arranged on the opposite sidewall 130, thus transmitting a signal corresponding to the desired numeral.

Thereafter, when the user desires to press another numeral, it is necessary for the user to merely push the push button 200 in the direction in which the desired numeral is present, unlike the conventional technology.

Accordingly, in the button structure according to the first embodiment of the present invention, the conventional inconvenience in which a desired button must be pressed after it is recognized from a plurality of pressing buttons can be eliminated, and several tens of conventional button functions can be enabled using only two button structures.

That is, the present invention can provide an electronic product's button structure which can transmit a plurality of signals using a single button, by attaching a plurality of contacts 400 thereto.

Furthermore, when the user releases the push button 200 after operating it, the push button 200 is restored to its original position by the elasticity of the restoring means 600.

Meanwhile, when compared with a button structure in which a plurality of contacts is located under a button and in which the button is operated by being pressed downwards, the present invention has the following advantages.

In the present invention, the contacts 300 are arranged along the side surface of the push button 200, so that a maximum space in which the contacts 400 can be located is ensured, and thus more contacts 400 can be mounted therein. In contrast, the design according to which a plurality of contacts is located under a button is problematic in that the space between the contacts is narrow, and thus the number of contacts mountable therein is limited.

Furthermore, the present invention is advantageous in that it allows the contacts 400 to be easily and accurately brought into contact with the respective points that are located on the opposite sidewall 130 because the circumference of the opposite sidewall 130, which comes into contact with the contacts 400, is greater than that of the push button 200, on which the contacts 400 are located.

Accordingly, even when protrusion sensors 300 are provided on the opposite sidewall 130, the contact of the contacts 400 can be accurately made because the distance between the neighboring protrusion sensors 300 is sufficiently great, as shown in FIG. 3(*b*).

Meanwhile, the first embodiment of the present invention may be more conveniently used as a manipulation key for game devices by attaching a stick, which will be described later, to the push button 200, or it may be used along with another type of button.

Figure 7:
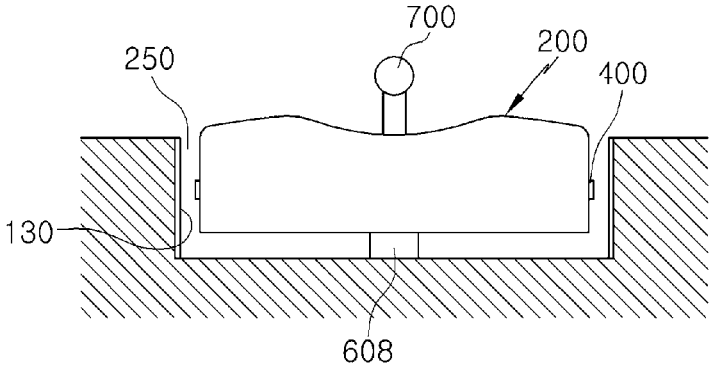
FIG. 7 is a schematic view showing the case where a stick is attached to the button structure according to the first embodiment of the present invention.
Figure 8:
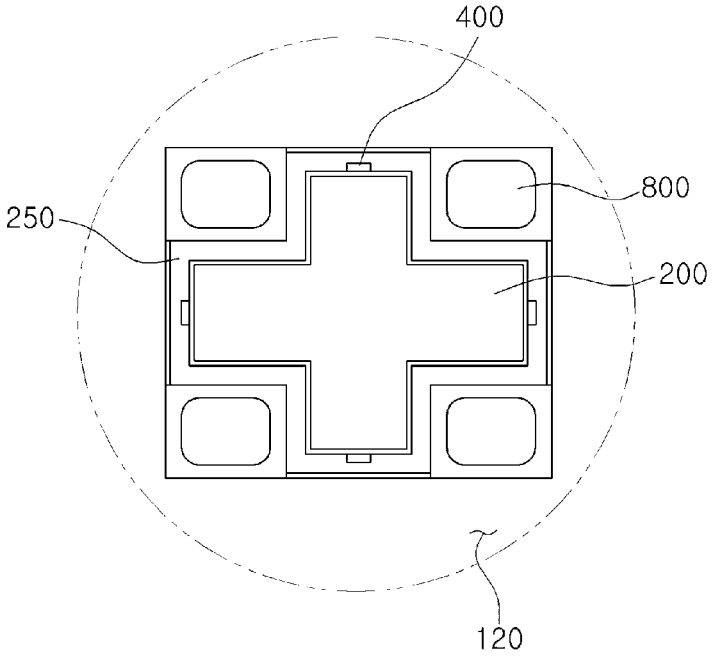
FIG. 8 is a schematic view showing the case where the button structure according to the first embodiment of the present invention is used along with other buttons.

FIG. 7 is a schematic view showing the case where a stick is attached to the button structure according to the first embodiment of the present invention, and FIG. 8 is a schematic view showing the case where the button structure according to the first embodiment of the present invention is used along with other buttons.

As shown in FIG. 7, in the case where, in the electronic product's button structure according to the first embodiment of the present invention, a stick 700 is provided on the upper side of the push button 200, the button structure can be used even when it is necessary to more quickly and rapidly manipulate a button, as in game playing.

Furthermore, as shown in FIG. 8, the push button 200 may be arranged in the housing 250 along with conventional pressing-type buttons 800.

A second embodiment of the present invention is a press and push button.

Figure 9:
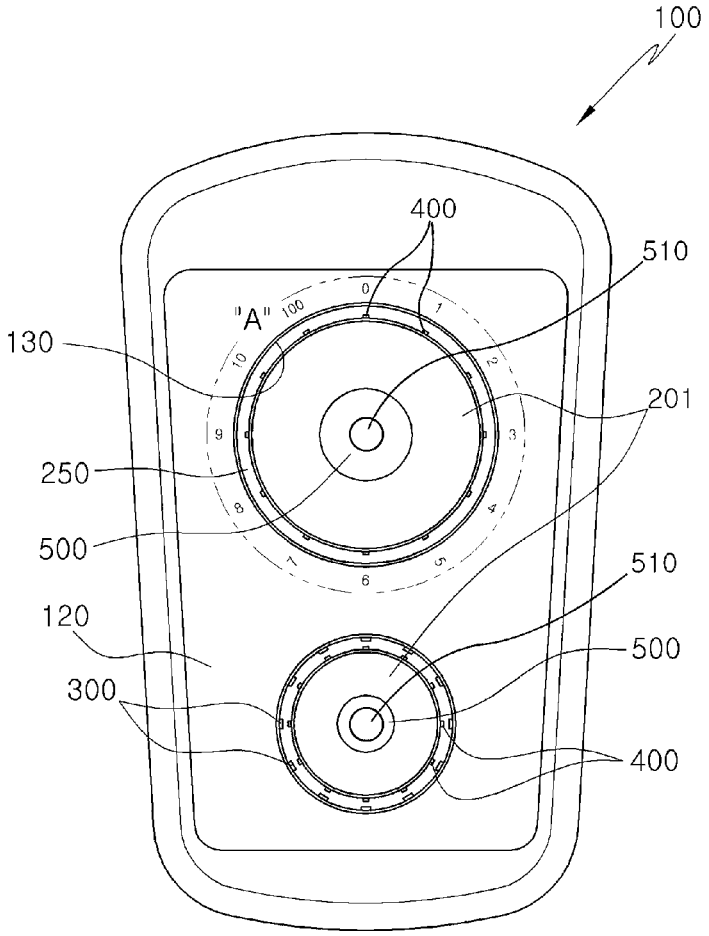
FIG. 9 is a schematic view showing a button structure, according to a second embodiment of the present invention.
Figure 10:
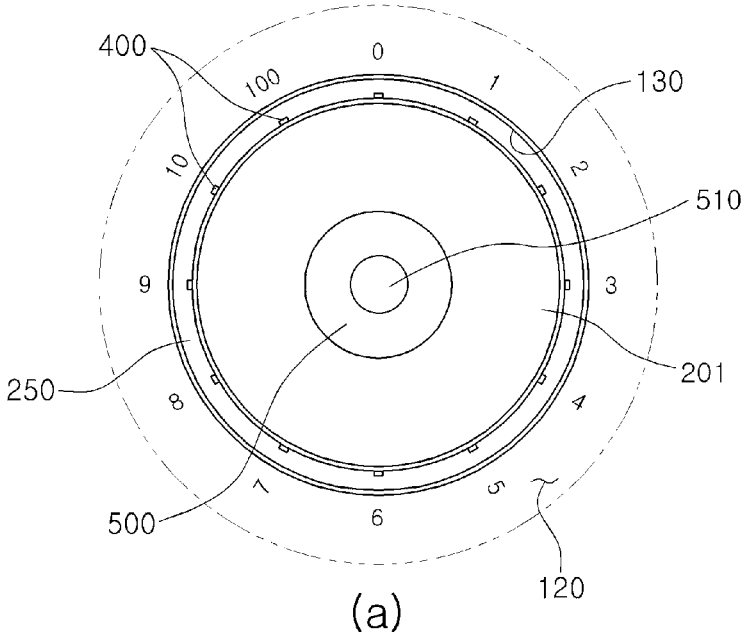
FIG. 10 is an enlarged view showing portion A of FIG. 9.
Figure 10:
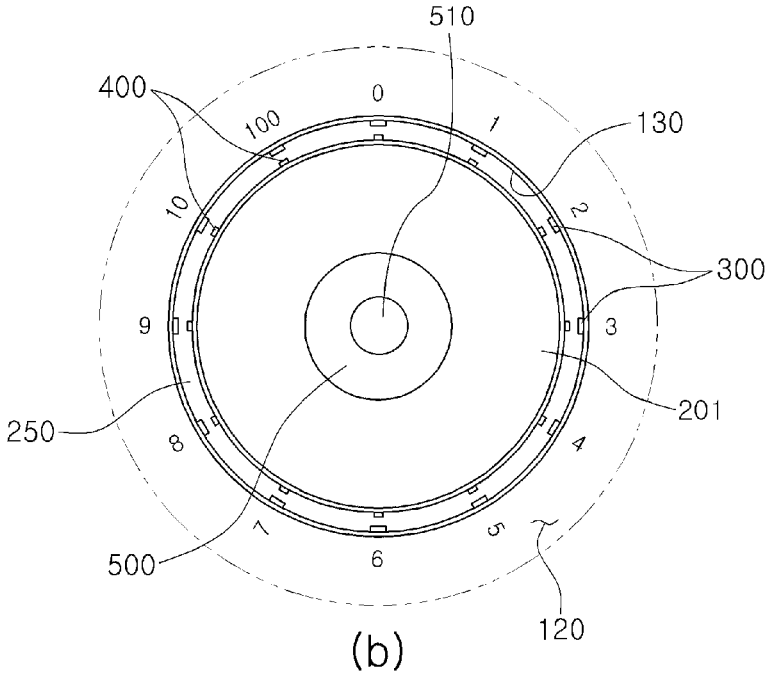
Figure 11:
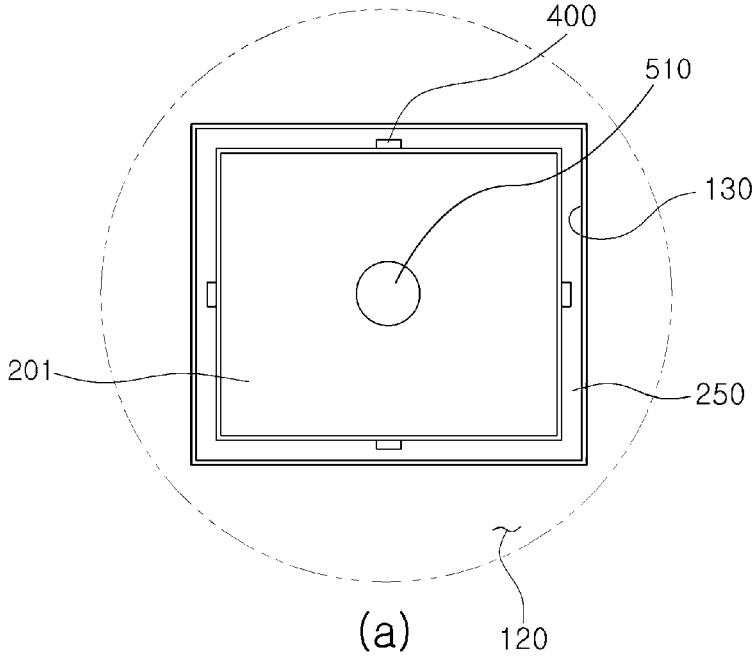
FIG. 11 a schematic view showing a modification of FIG. 10.
Figure 11:
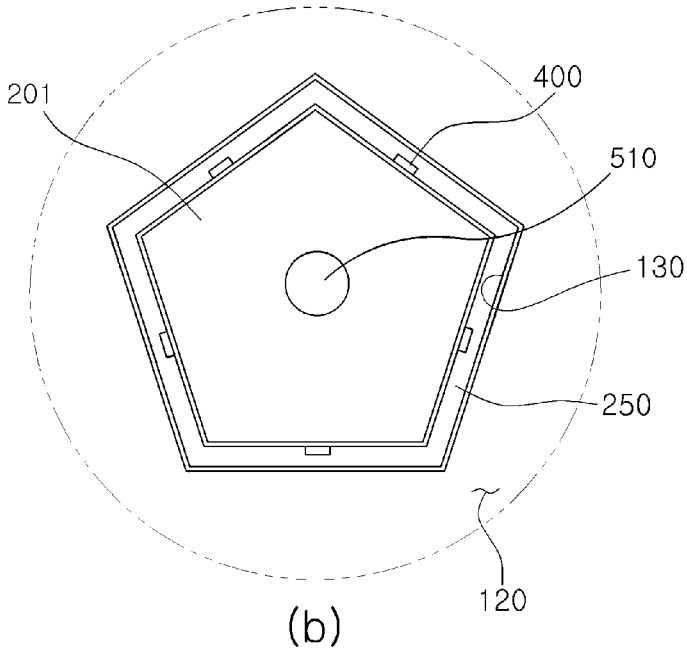

FIG. 9 is a schematic view showing a button structure for electronic products, according to a second embodiment of the present invention, FIG. 10 is an enlarged view showing portion A of FIG. 9, and FIG. 11 a schematic view showing a modification of FIG. 10.

As shown in FIGS. 9 and 10, the button structure according to the second embodiment of the present invention may be used in an implementation of a remote controller 100, including one or more press and push buttons 201, each of which is configured such that a pressing button 510 is provided in the central portion thereof, further including one or more housings 250, each of which is provided with an opposite sidewall 130, which is configured to surround the corresponding press and push button 201 and to transmit or receive a signal to and from, respectively, the side surface of the press and push button 201, and also including a casing 120, which is provided with the housings 250.

Furthermore, Arabic numerals ranging from 0 to 10 and an Arabic numeral of 100 are drawn along the outer circumference of the housing 250. The plurality of contacts 400 are used to generate their corresponding signals. In this case, the signals correspond to the above Arabic numerals.

As needed, the Arabic numeral designations may be changed into letters of the Latin alphabet or the Korean alphabet, and a plurality of contacts 400 or sensors may be provided on the side surface of the press and push button 201 or on the opposite sidewall 130.

Furthermore, as shown in FIG. 10(*b*), the sensors may be provided in the form of protrusion sensors 300, which protrude towards the contacts 400 from locations opposite those of the contacts 400. In this case, the protrusion sensors 300 functions to enable the contacts 400 to be more easily brought into contact with the neighboring opposite sidewall 130.

The contacts 400 may be implemented using typical contacts 400, which are brought into contact with the protrusion sensors 300 and generate signals in such a way that current flows to a circuit that is connected with the protrusion sensors 300, or may be implemented using transmission sensors, which transmit signals when they are brought into contact with or merely approach the reception protrusion sensors 300.

Accordingly, the contacts 400 or the protrusion sensors 300 may be pressure sensors, optical sensors or ultrasonic sensors.

Meanwhile, finger contact parts 500, which are formed to be concavely curved, are provided in the respective upper portions of the press and push buttons 201. In this case, the finger contact parts 500 enable the press and push buttons 201 to be more reliably and accurately manipulated when the press and push buttons 201 are manipulated by placing fingers on the finger contact parts 500.

Furthermore, the press and push buttons 201 are generally mounted in a circular shape, as shown in FIG. 10, but, as needed, the press and push buttons 201 may be mounted in the form of a variety of shapes, as shown in FIG. 11. The press and push buttons 201 and the housings 250 may be formed to have a polygonal transverse cross section, such as a tetragonal, shown in FIG. 11(*a*), or a pentagonal, shown in FIG. 11(*b*).

Meanwhile, the internal structure of the press and push button 201 is described below.

Figure 12:
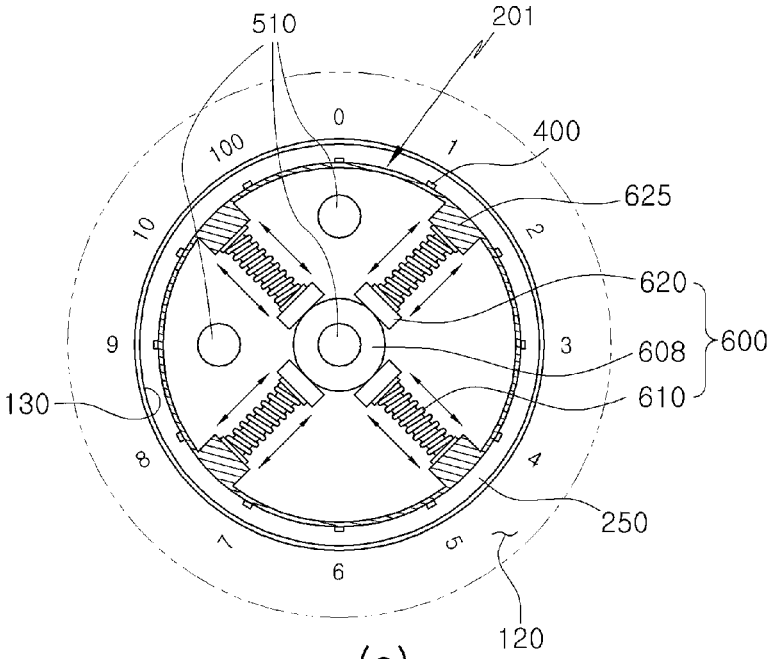
FIG. 12 is a sectional view showing the internal structure of the button shown in FIG. 10.
Figure 12:
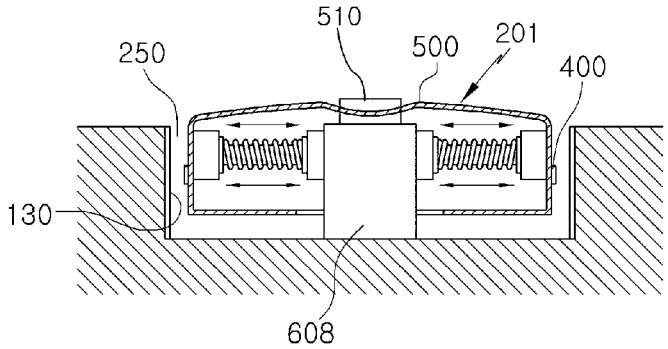
Figure 13:
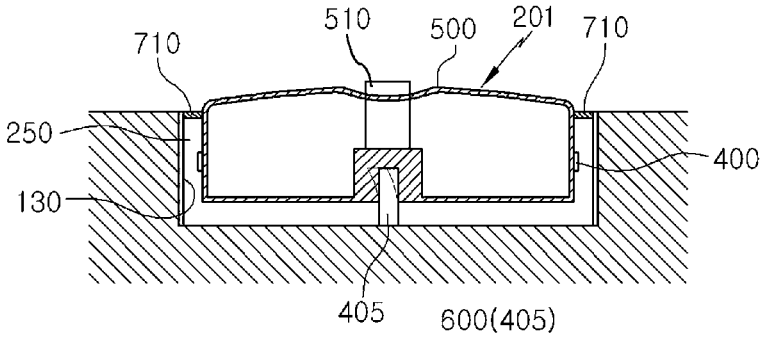
FIG. 13 is a schematic view showing a modification of FIG. 12.

FIG. 12 is a sectional view showing the internal structure of the button shown in FIG. 10, and FIG. 13 is a schematic view showing a modification of FIG. 12.

A restoring means 600 is provided in the press and push button 201, and is configured such that it is restored to its original position when a user releases the press and push button 201 after moving it.

Furthermore, although, in the present invention, various types of restoring means 600 may be provided, a first type of restoring means 600, shown in FIG. 12, and a second type of restoring means 600, shown in FIG. 13, will be described below.

The first type of restoring means 600, shown in FIG. 12, includes a central shaft 608, which is provided in the central portion of the press and push button 201, and springs 610, which are connected to the central shaft 608 at 90 degree intervals in the circumferential direction of the central shaft 608.

Furthermore, pressing members 620 are provided between the central shaft 608 and the springs 610, and spring seating parts 625 are formed on the internal sidewall of the press and push button 201.

Furthermore, the springs 610 all have the same elasticity, so that the press and push button 200 is always located in the central portion of the housing 250 except for the case where the user operates the press and push button 201.

Meanwhile, the pressing button 510 is formed on the central shaft 608. In this case, devices, such as restoring elastic devices and signal detection sensors, which are used for a typical pressing button, are mounted in the central shaft 608 so that the operation of the pressing button 510 can be enabled.

Accordingly, the press and push button 201 functions as an integrated button, which is formed by integrating the pressing button and the push button with each other so as to transmit a larger variety of signals.

Furthermore, as needed, a plurality of pressing buttons 510 may be provided. The pressing buttons may also be provided around the central shaft 608.

The reason for this is that the press and push button 201 has a structure which is merely pushed in all directions without being rotated around the axis of the central shaft 608.

Meanwhile, the second type of restoring means 600, shown in FIG. 13, includes an elastic member 405. The elastic member 405 is formed of a leaf spring, or is made of synthetic resin or synthetic rubber, which has elasticity.

Furthermore, a gap cover 710 is provided between the press and push button 201 and the opposite sidewall 130, so that the interruption of contact between the contacts 400 and the opposite sidewall 130 due to dust or foreign materials, which enters into the space between the press and push button 201 and the protrusion sensors 300, can be prevented. In this case, the gap cover 710 is formed in the shape of a thin elastic membrane so as not to interfere with the movement of the press and push button 201.

Furthermore, the pressing button 510 may be provided over the elastic member 405. The pressing button 510 functions as a typical pressing button.

The button structure according to the second embodiment of the present invention, which is constructed as described above, is described below.

When a user desires to press one numeral in order to manipulate the remote controller 100, it is necessary to move the press and push button 201 towards the desired numeral, to be selected from among the numerals that are provided along the circumference of the housing 250. When the push button 200 is moved, a contact 400 is brought into contact with a corresponding protrusion sensor 300, formed on the opposite sidewall 130, and thus a signal corresponding to the desired numeral is transmitted.

Thereafter, when the user desires to press another numeral, it is necessary for the user to merely push the press and push button 201 in the direction in which the desired numeral is present, unlike the conventional technology.

Furthermore, the user can press the pressing button 510 so that other functions can be performed. For this reason, a large number of button functions can be implemented.

Accordingly, in the button structure according to the second embodiment of the present invention, the conventional inconvenience in which a desired button must be pressed after it is recognized from a plurality of pressing buttons can be eliminated, and several tens of conventional button functions can be performed using only two button structures.

Furthermore, when the user releases the press and push button 201 after operating it, the push button 200 is restored to its original position by the elasticity of the restoring means 600.

Meanwhile, the second embodiment of the present invention may be more conveniently used as a manipulation key for game devices by attaching a stick, which will be described later, to the press and push button 201, or it may be used along with another type of button.

Figure 14:
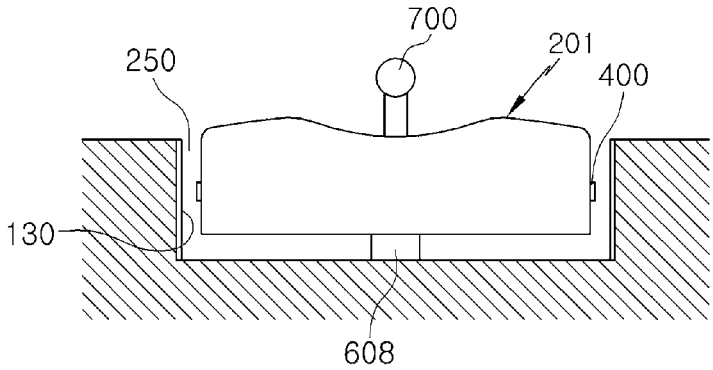
FIG. 14 is a schematic view showing the case where a stick is attached to the button structure according to the second embodiment of the present invention.
Figure 15:
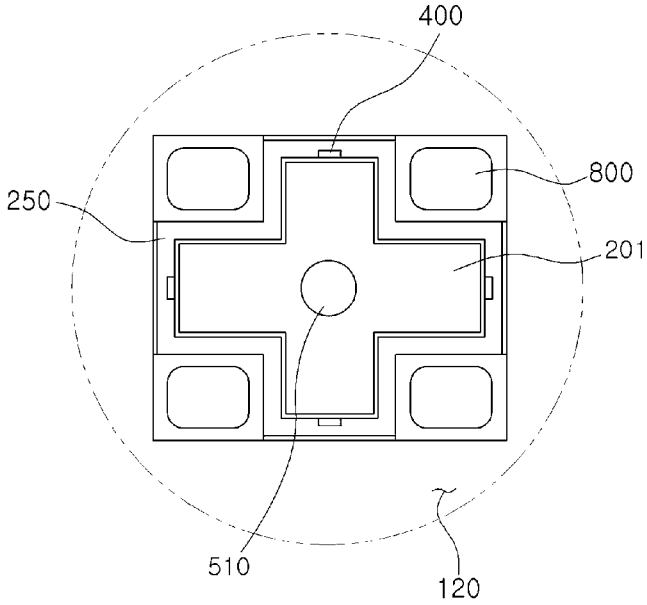
FIG. 15 is a schematic view showing the case where the button according to the second embodiment of the present invention is used along with other buttons.

FIG. 14 is a schematic view showing the case where a stick is attached to the button structure according to the second embodiment of the present invention, and FIG. 15 is a schematic view showing the case where the button according to the second embodiment of the present invention is used along with other buttons.

As shown in FIG. 14, in the case where, in the button structure for electronic products according to the second embodiment of the present invention, a stick 700 is provided on the upper side of the press and push button 201, the button structure can be used even when it is necessary to quickly and rapidly manipulate a button, as in game playing. In this case, the stick 700 also functions as the pressing button.

Furthermore, as shown in FIG. 15, the press and push button 201 may be arranged in the housing 250 along with conventional pressing-type buttons 800.

A third embodiment of the present invention is a touch and push button.

The touch and push button is implemented by changing the pressing button 510 structure of the press and push button 201, shown in FIGS. 9 to 15, into a touch structure, to which a touch sensor is attached.

The touch and push button is configured such that signals are generated from the side contacts 400 and such that a separate touch sensor is attached to the upper surface of the push button. Accordingly, a user can use the function of the pressing button 510 by touching the touch sensor, rather than by pressing the pressing button 510.

The touch and push button is configured to transmit signals through the contacts 400 and the touch sensor. Accordingly, when a corresponding button is merely touched, a pressing button type effect can be achieved and, at the same time, a large number of signals can be generated through a push operation, which is performed before or after a touch operation.

In the pressing button 510, a signal is generated only when the button is pressed, that is, when pressure is applied downwards, whereas in the touch button using a touch sensor, the same signal as that generated by the pressing structure is generated even when a finger is merely placed on the upper surface of the button. Accordingly, the touch button is advantageous in that it can be more conveniently operated. Furthermore, the pressing button 510 has a protruding structure, whereas the touch button may be provided to a height identical to that of each finger contact part 500. Accordingly, thin products can be manufactured.

A method of operating the touch and push button is described below.

When a user touches the touch and push button, which is mounted in the volume control unit of a TeleVision (TV) remote controller, a volume indication is graphically displayed on a TV display.

In this case, when the user pushes the touched button in one direction, the volume is increased. In contrast, when the user pushed the touched button in the opposite direction, the volume is decreased.

Furthermore, in the case where the touch and push button is applied to a mobile phone keypad structure, a touch-type keypad made up of an arrangement of individual touch and push buttons may be manufactured. In the touch-type keypad, various additional signals may be input by combining an up, down, left and right push structure for each key, in addition to the structure in which the individual buttons primarily generate signals through touch operations.

Meanwhile, in the case where the touch and push button is laterally pushed by a finger being placed on the touch sensor, an erroneous operation in which the finger slides and, thus, a neighboring button is touched, may occur. In order to prevent this erroneous operation from occurring, protrusions may be provided around the respective finger contact parts 500 so that a button is pushed but a finger does not move out of the upper surface area of the button.

A fourth embodiment of the present invention is a wheel key push button.

Figure 16:
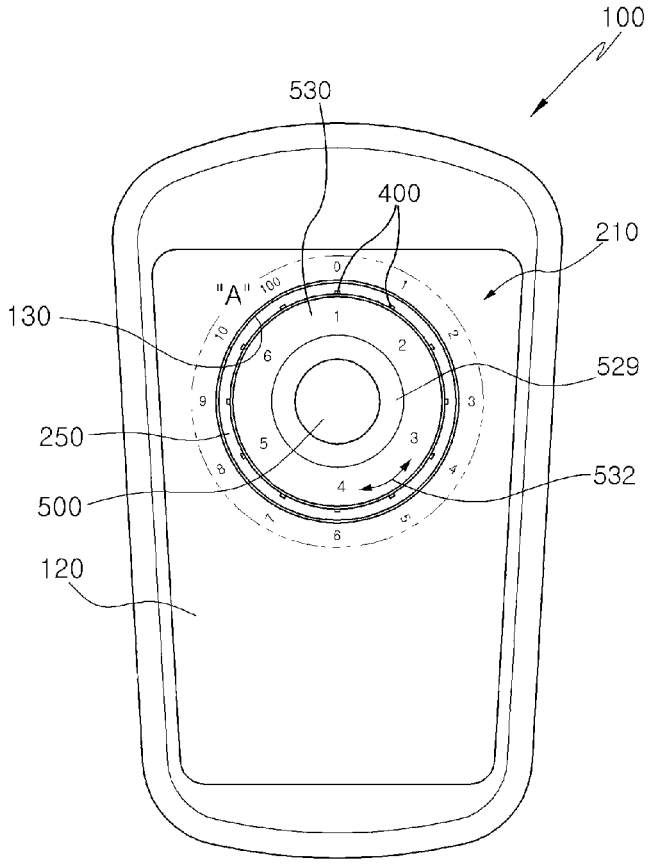
FIG. 16 is a front view showing a wheel key push button.

FIG. 16 is a front view showing a wheel key push button.

A wheel key push button 210 has a structure in which the pressing button 510 is removed from the press and push button 201, shown in FIGS. 9 to 15, and the upper surface of the button is divided into a central part 529 and a wheel key part 530 with a predetermined radius as shown in FIG. 16, the wheel key part 530 being rotated around the central part 529 in the direction of an arrow 532.

Accordingly, the wheel key push button 210 has a structure in which signals are generated from contacts 400 disposed around the circumference thereof, and the wheel key part 530 of the wheel key push button 210 is rotated around the central part 529 in the direction of the arrow 532.

The operation of the wheel key push button 210 is described by means of an example below.

When a user rotates the wheel key part 530 in a wheel key push button 210 mounted on a TV remote controller, specific signal indications, such as channel/volume/screen ratios, are continuously displayed on the display of a Braun tube TV.

In this case, when a desired signal is displayed, the user stops rotation of the wheel key part 530, and then causes a subsequent signal to be transmitted by pushing the wheel key push button 210.

A fifth embodiment of the present invention is a bar-type push button.

Figure 17:
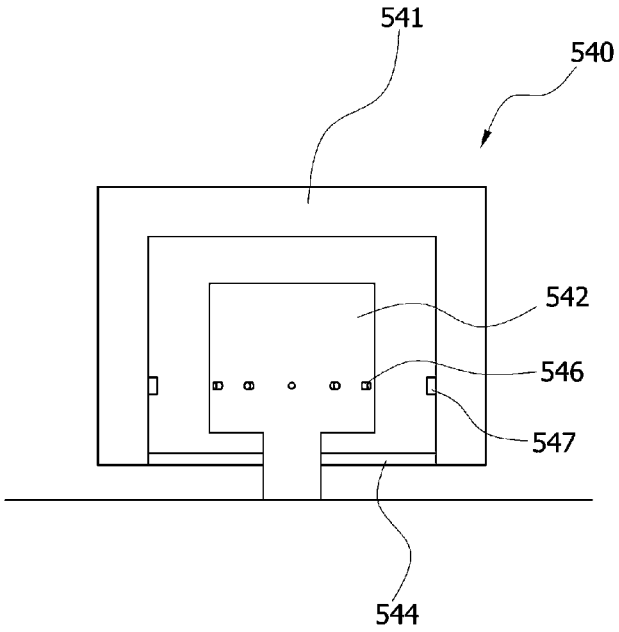
FIG. 17 is a sectional view showing a bar-type push button.

FIG. 17 is a sectional view showing a bar-type push button.

The bar-type push button 540 includes a push button 541 having a cap shape, and an inner bar 542 provided in the push button 541, and has a structure in which contacts 546, which are arranged on the circumferential surface of the inner bar 542, are brought into contact with sensors 547, which are arranged on the inner surface of the push button 541.

Furthermore, a restoring member 544 is provided between the push button 541 and the inner bar 542.

Although the bar-type push button 540 has a structure different from the push button according to the present invention, the operation thereof of is the same as that of the operation of the push button.

That is, when a user pushes the push button 541, a contact 546 of the inner bar 542 is brought into contact with a corresponding sensor 547, which is arranged on the inner surface of the push button 541, and thus a signal is transmitted. Furthermore, as needed, the sensors 547, instead of the contacts 546, may be attached to the inner bar 542, and the contacts 546, instead of the sensors 547, may be attached to the inner surface of the push button 541.

Furthermore, the bar-type push button 540 may additionally generate various signals while maintaining the function of the push button in the case where at least one of the pressing button 510, the touch sensor and the wheel key part 530 is attached to the upper surface or outer sidewall of thereof.

A sixth embodiment of the present invention is a display push button, in which character indication display windows for respective contacts are provided around a button part.

Figure 18:
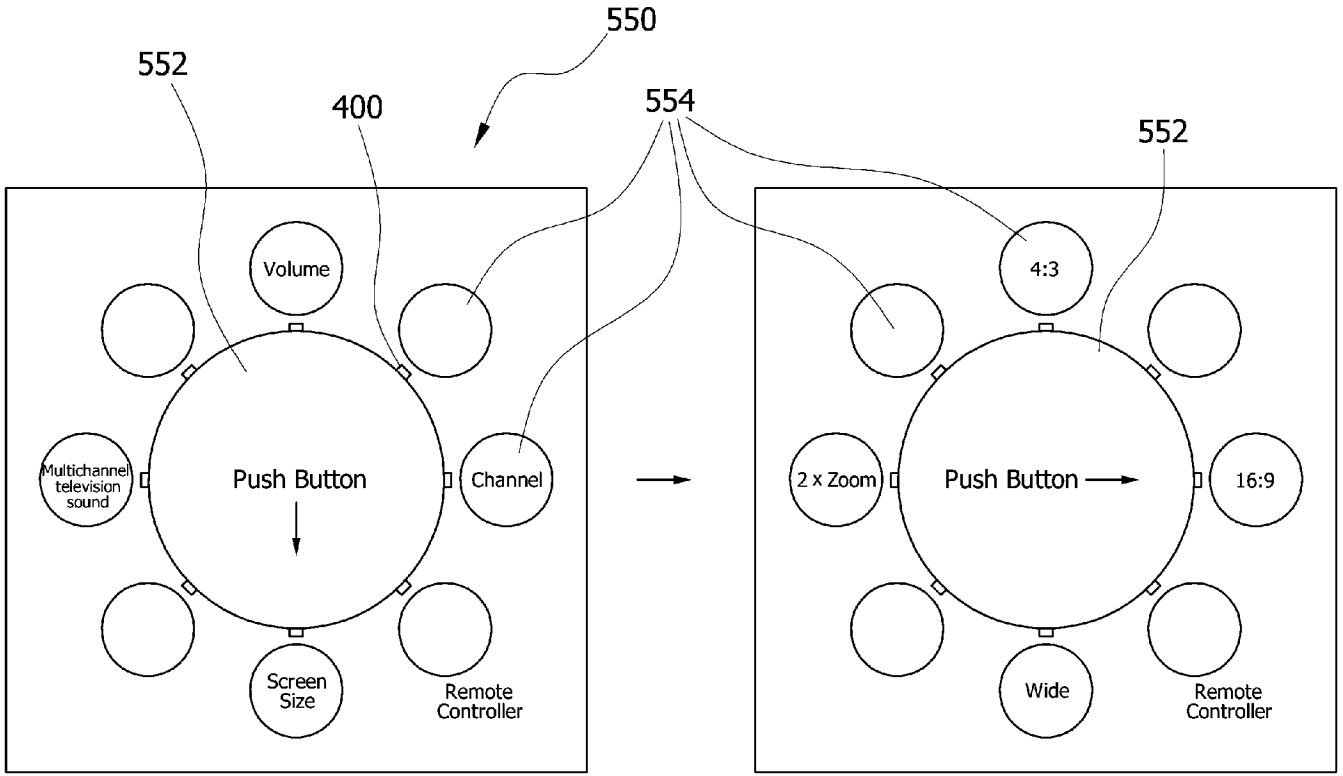
FIG. 18 is a schematic view of a display push button in a button structure for electronic products according to a sixth embodiment of the present invention.

FIG. 18 is a schematic view a display push button in a button structure for electronic products according to a sixth embodiment of the present invention.

The display push button 550 is configured such that display windows 554 are provided around the respective contacts 400 of a push button 552.

The display push button 550 is described by way of example. Contacts 400 are provided around the push button 552 of a TV remote controller, shown in FIG. 18, and display windows 554, in which 'Volume,' 'Channel,' 'Screen size' and 'Multichannel television sound' are indicated, are arranged close to the respective contacts 400.

In this state, when the 'Screen size' is touched by the display push button 550, a change in a menu is made and, thus, '4:3', '16:9', 'Wide' and '2× zoom' screens are indicated in the display windows 554 close to the respective contacts 400 of the display push button 550. In this case, when a desired signal is 16:9, the push button 552 must be pushed to a display window 554 in which '16:9' is indicated.

When the contacts 400 are brought into contact with the display windows 554, the generation of a signal, conducted by a user, may be shown using a method of changing the colors of the display windows 554, and a corresponding menu may also be displayed on a TV display.

If the menu is effectively configured, the above-described display push button 550 can generate various signals using only one or two push buttons without requiring that a plurality of push buttons be used.

Figure 19:
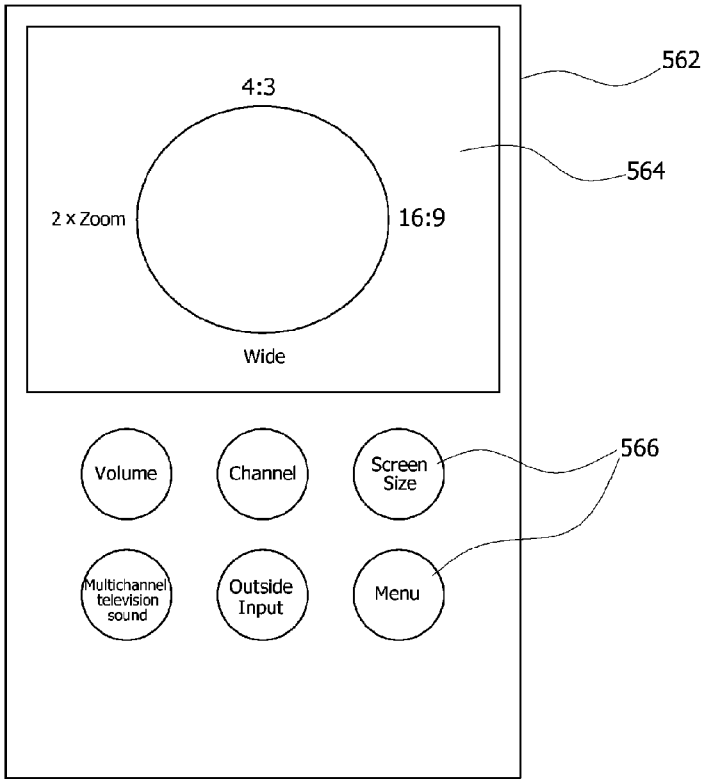
FIG. 19 is a front view showing the case where a unified display part is provided separately from the push buttons.

FIG. 19 is a front view showing the case where a unified display part is provided separately from push buttons.

In the case of the circular press and push button 201 having a large number of contacts 400, shown in FIG. 9, when a finger is placed on the button, inconvenience may occur in that the numerals that are indicated around the upper portion of the button for the respective contacts 400 can be viewed, but the numerals that are indicated around the lower portion of the button cannot be viewed because they are covered by the finger.

As a modification of the display push button 550, a remote controller 562 is configured such that the unified display part 564 is spaced apart from the push buttons 566 as shown in FIG. 19. Accordingly, when a user presses or touches a specific one of the push buttons 566, which are arranged in the lower end of the remote controller 562, a screen corresponding to the generated signal may be graphically displayed on the unified display part 564.

In this case, it is required to merely perform a push operation on the push buttons 566, which are arranged in the lower end of the remote controller 562, in a predetermined direction without requiring that individual signal indications be separately made around the contacts, and thus there is an advantage in that the size of each push button 566 can be minimized.

Furthermore, for specific contacts, the generation of a signal, conducted by a user, may be shown using a method of changing the colors of the display windows, and a corresponding menu may also be displayed on a TV display.

A seventh embodiment of the present invention is a pressure push button that enables the adjustment of a speed using pressure sensors.

The pressure push button 570 is implemented using typical pressure sensors, rather than using the contacts or sensors which are used in the first to sixth embodiments.

Figure 20:
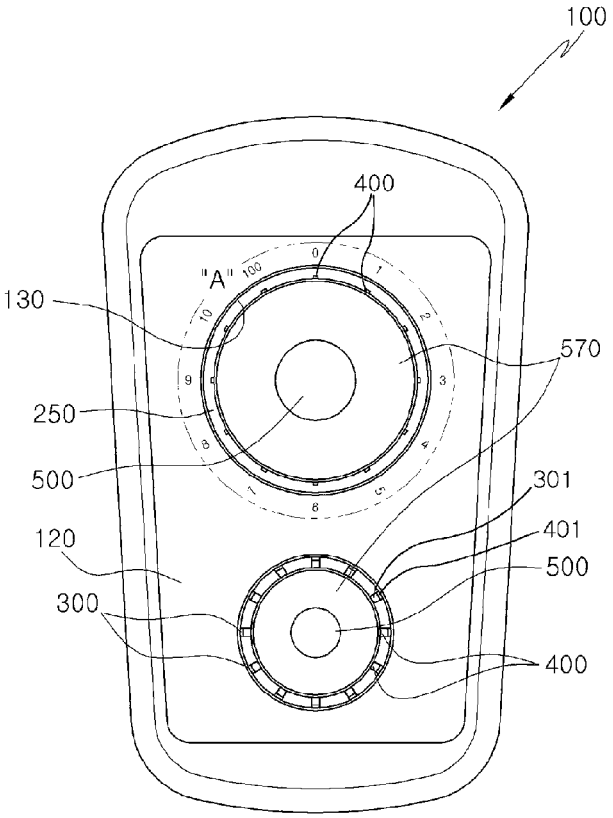
FIG. 20 is a front view showing a non-contact push button and a pre-contact pressure push button.

FIG. 20 is a front view showing a non-contact push button and a pre-contact pressure push button.

As needed, the contacts 301 of the pressure push button 570 and the contacts 401 of the opposite sidewall are in contact with each other at the early stage as in the pre-contact pressure push button, which is provided in the lower portion of FIG. 20. Accordingly, when a user pushes the pressure push button 570, the contacts 301 of the pressure push button 570 may transmit pressure to the contacts 401 of the opposite sidewall.

The pressure sensors are devices that transmit signals which vary according to the pressure that is applied when the user pushes the opposite sidewall using the pressure push button 570. For example, in the case of a TV channel or volume, the user may quickly or slowly change the channel or volume by adjusting the push pressure that is applied when the pressure sensors are pressed.

Figure 21:
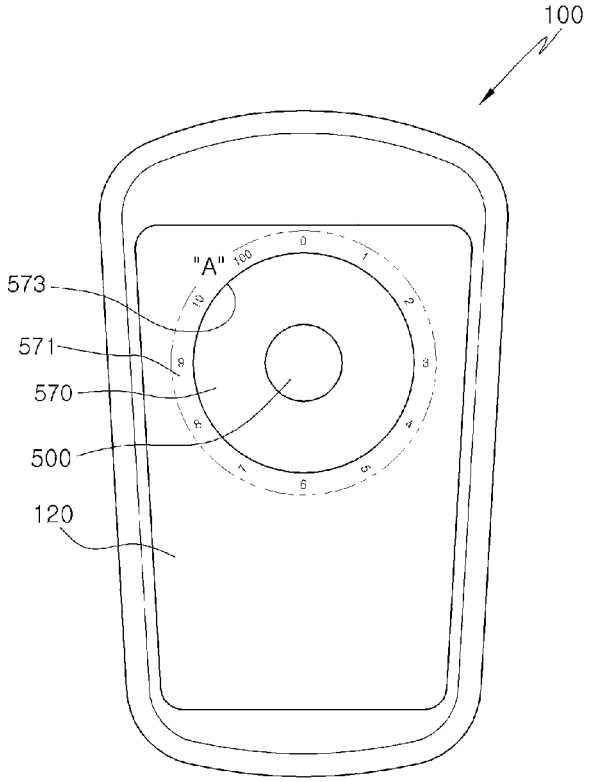
FIG. 21 is a view showing the state in which no gap exists in the boundary between a pressure push button and an opposite sidewall.

FIG. 21 is a view showing the state in which no gap exists in the boundary between a pressure push button and an opposite sidewall.

A pressure push button 570 using a method of detecting pressure from the pushed portion of the opposite sidewall 571 when the pressure push button 570 pushes the opposite sidewall 571, in the state in which the gap in the boundary 573 between the pressure push button 570 and the opposite sidewall 571 is removed and the pressure push button 570 and the opposite sidewall 571 are in contact with each other at the early stage, as shown in FIG. 21, may be provided.

An eighth embodiment of the present invention, in which the pressure sensors in the seventh embodiment are replaced with optical sensors or ultrasonic sensors, which are non-contact sensors, is an optical push button or an ultrasonic push button, in which separate contacts are unnecessary.

That is, in the case where typical optical sensors or ultrasonic sensors are used in place of the contacts and the sensors, which have been used in the first and sixth embodiments, either contacts or sensors are used as transmission sensors or reception sensors, and the others are used as opposite sensors.

In this case, the push button and the opposite sidewall, in which the optical sensor or the ultrasonic sensor are provided, are spaced apart from each other, are provided such that a signal varies according to the velocity, with which the push button approaches the opposite sidewall, and the approaching distance and is transmitted.

Meanwhile, as needed, an integrated button device, which enables various composite signals to be transmitted by a single button, formed by integrating the variety of types of buttons ranging from the first embodiment to the eighth embodiment, may be provided in a single remote controller.

As described above, the button structures for electronic products according to the present invention can perform a number of button functions using simple constructions.

The above description is illustrative in order to convey the technical spirit of the present invention, and a person having ordinary knowledge in the technical field to which the present invention pertains will appreciate that various modifications and variations are possible within the range that does not depart from the substantial characteristics of the present invention. Accordingly, the embodiments disclosed in the present invention are not limitative to the spirit of the present invention and are only illustrative, and the scope of the technical spirit of the present invention is not to be defined by the embodiments. The scope of the present invention should be understood with reference the accompanying claims, and all technical variations within the equivalent scope should be understood as being included within the scope of the present invention.

The invention claimed is:

1. A button structure for electronic products, comprising:

a central shaft;

a push button configured to be movable without rotating around an axis of the central shaft and comprising a pressing button; and an opposite sidewall surrounding the push button and configured to transmit a signal to a side surface of the push button or receive a signal from the side surface of the push button, wherein contacts are provided on one of the side surface of the push button and the opposite sidewall and sensors are provided on the other at positions corresponding to the contacts, wherein when the push button is moved without rotating around an axis of the central shaft, the contacts are moved toward the sensors so as to allow the sensors to generate signals, wherein the press and the push button functions as an integrated button, which is formed by integrating the pressing button and the push button with each other so as to transmit a larger variety of signals.

2. The button structure according to claim 1, wherein the contacts or the sensors are pressure sensors, optical sensors or ultrasonic sensors.

3. The button structure according to claim 2, wherein the push button and the opposite sidewall, on which the pressure sensors are provided, are arranged so as to be able to be brought into contact with each other.

4. The button structure according to claim 3, wherein a signal varies according to a pressure applied when the push button presses the opposite sidewall and is transmitted.

5. The button structure according to claim 2, wherein a signal is generated when the push button approaches the opposite sidewall in a state in which the push button and the opposite sidewall, on which the optical sensors or the ultrasonic sensors are provided, are separated from each other.

6. The button structure according to claim 5, wherein the signal varies according to a velocity, with which the push button approaches the opposite sidewall, and an approaching distance and is transmitted.

7. The button structure according to claim 1, 2, 3, 4, 5, or 6, further comprising: a unified display part , which is spaced apart from the push button.

8. The button structure according to claim 1, 2, 3, 4, 5, or 6, further comprising: display windows, which are provided around the contacts of the push button.

* * * * *